US008714695B2

(12) United States Patent
Ishida

(10) Patent No.: US 8,714,695 B2
(45) Date of Patent: May 6, 2014

(54) TRANSPORTATION ROLLER CLEANING MECHANISM AND PRINTER

(75) Inventor: Tetsugo Ishida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 269 days.

(21) Appl. No.: 13/115,033

(22) Filed: May 24, 2011

(65) Prior Publication Data

US 2011/0292143 A1 Dec. 1, 2011

(30) Foreign Application Priority Data

May 26, 2010 (JP) ..... 2010-120210

(51) Int. Cl.
*B41J 2/165* (2006.01)
*B41J 2/01* (2006.01)
*B41J 29/13* (2006.01)

(52) U.S. Cl.
USPC ..... 347/22; 347/33; 347/101; 347/108

(58) Field of Classification Search
USPC ..... 347/101, 22, 33, 108
See application file for complete search history.

(56) References Cited

U.S. PATENT DOCUMENTS

| | | | | |
|---|---|---|---|---|
| 5,356,231 | A | 10/1994 | Nakamura et al. | |
| 5,404,154 | A * | 4/1995 | Tomari et al. | 347/153 |
| 5,636,929 | A * | 6/1997 | Asano et al. | 400/641 |
| 5,719,611 | A | 2/1998 | Nakamura et al. | |
| 6,318,837 | B1 * | 11/2001 | Barinaga | 347/33 |
| 7,563,045 | B2 * | 7/2009 | Nagata | 400/693 |
| 8,277,039 | B2 * | 10/2012 | Nakamaki et al. | 347/104 |
| 2008/0225068 | A1 * | 9/2008 | Morino et al. | 347/14 |
| 2011/0050831 | A1 * | 3/2011 | Yamada | 347/215 |

FOREIGN PATENT DOCUMENTS

| | | | |
|---|---|---|---|
| JP | 06-032023 | A | 2/1994 |
| JP | 6-182983 | A | 7/1994 |
| JP | 08-067372 | A | 3/1996 |
| JP | 10-291675 | A | 11/1998 |
| JP | 2006-306512 | A | 11/2006 |
| JP | 2009-096065 | A | 5/2009 |
| JP | 4407566 | B2 | 11/2009 |
| JP | 2010-006523 | A | 1/2010 |

* cited by examiner

*Primary Examiner* — Sarah Al Hashimi
(74) *Attorney, Agent, or Firm* — Kilpatrick Townsend & Stockton LLP

(57) ABSTRACT

Ink on a transportation roller that touches the printing surface of a recording medium can be regularly removed without affecting media transportation performance. The cleaning mechanism has a cleaning lever that is pivotably supported with one end extending to above the discharge follower roller downstream from the printing position and the other end urged upward. When a cover attached to the roll paper loading opening is closed, the cleaning lever is held in resistance to this urging force at a position not touching the discharge follower roller by the fixed knife and movable knife of a cutter disposed downstream from the discharge follower roller. When the cover starts to open, the movable knife on the platen unit moves and the fixed knife separates from the cleaning lever, and the cleaning lever contacts the discharge follower roller.

9 Claims, 5 Drawing Sheets

TRANSPORTATION ROLLER CLEANING MECHANISM AND PRINTER

This application claims priority to Japanese Patent Application No. 2010-120210, filed May 26, 2010, the entirety of which is incorporated by reference herein.

BACKGROUND

1. Technical Field

The present invention relates to a cleaning mechanism for removing ink from a transportation roller that is positioned to contact the printing surface of the recording medium, and to a printer having this cleaning mechanism.

2. Related Art

Some printers that print by ejecting ink onto a recording medium have transportation rollers disposed downstream from the printhead to grip the printed recording medium from both sides and convey the recording medium toward a paper exit. Because one of the rollers in this transportation roller pair contacts the printed side of the recording medium, undried ink may be picked up by the roller surface. Ink accumulated on the roller surface can then transfer to the recording medium and soil the printed surface. Some devices therefore suppress ink buildup and retransfer to another surface by forming grooves in the roller surface. A cleaning member could also be provided to remove any ink and clean the roller surface.

Japanese Unexamined Patent Appl. Pub. JP-A-H06-182983 teaches a printer that uses grooved spurs as the roller that contacts the printing surface. This printer also has a cleaning roller that rotates in constant contact with the spurs and removes ink at the same time as the spurs rotate. The position of the spurs is also automatically adjusted according to the thickness of the recording medium in this printer, and when the spurs move, the cleaning roller also moves following the spurs. The cleaning roller therefore does not interfere with retracting the spurs, and can clean the spurs without affecting paper feed performance.

Japan Patent No. 4407566 teaches a printer that has a cleaning member disposed at the front of the tray used to load a CD, DVD, or other recording medium into the printer. When the tray is inserted in this printer, the discharge follower roller on which there is ink contacts the cleaning member, and the ink is removed from the roller. Because cleaning occurs when the tray is loaded and unloaded with this configuration, cleaning can be performed without affecting transportation performance. In addition, because the cleaning member is on the tray side, the removed ink is discharged with the tray from the printer.

A problem with the related art taught in JP-A-H06-182983 is that because the cleaning roller is in constant contact with the spurs while the spurs (transportation roller) rotate, cleaning continues constantly while the recording medium is conveyed, and the ink removed from the spurs builds up on the cleaning roller while the recording medium is conveyed. However, JP-A-H06-182983 is silent about how to remove accumulated ink from the cleaning roller, and ink on the cleaning roller can transfer back onto the spurs while conveying the recording medium and soil the printing surface.

With the printer taught in Japan Patent No. 4407566, cleaning does not occur unless printing on a CD, DVD, or similar recording medium because cleaning occurs only when the tray moves in and out. Cleaning may therefore not occur as frequently as needed when the user uses a printer such as taught in Japan Patent No. 4407566 but does not print on recording media such as CDs or DVDs.

SUMMARY

A transportation roller cleaning mechanism according to the invention can remove ink from a transportation roller disposed to a position touching the printing surface of a recording medium, and discharge the ink from the printer, at suitable times without affecting media transportation performance and without burdening the user.

A first aspect of the invention is a transportation roller cleaning mechanism that is a cleaning mechanism for removing ink from a transportation roller that rotates in contact with the printing surface of a recording medium at a position downstream on the recording medium transportation path from a printing position where ink is discharged onto the passing recording medium, the cleaning mechanism including a cleaning member that can move between a cleaning position in contact with the transportation roller and a retracted position not in contact with the transportation roller. The cleaning mechanism moves to the cleaning position in contact with the transportation roller in conjunction with an operation starting to open an access cover for opening and closing a storage unit that holds the recording medium that is supplied to the printing position, and moves to the retracted position not in contact with the transportation roller in conjunction with an operation closing the access cover.

With this aspect of the invention the cleaning mechanism contacts the transportation roller when the access cover opens, and cleaning is thus performed whenever the access cover opens and closes, such as when the recording medium is replaced. Cleaning is therefore performed at least every time the recording medium is replaced even without the user keeping track of how often cleaning occurs. Cleaning can therefore be performed at the required frequency without the user needing to think about it. Cleaning is also not performed during normal media conveyance operations because the cleaning member does not touch the transportation roller when the access cover is closed. Cleaning can therefore be done without affecting transportation performance (paper feed performance). In addition, because the access cover opens when cleaning, the ink waste removed from the transportation roller can be smoothly discharged to the outside.

Further preferably in another aspect of the invention, a groove is formed in the roller surface of the transportation roller; and a protrusion corresponding to the groove is formed in the surface of the cleaning member that contacts the transportation roller.

This aspect of the invention reduces the contact area between the printing surface and the roller, and reduces ink transfer to the roller Ink accumulating in the grooves can also be scraped out and removed.

Further preferably, a transportation roller cleaning mechanism according to another aspect of the invention also has an urging member that urges the cleaning member to the cleaning position side, and a cutter having a movable knife and a fixed knife that is urged to the movable knife side downstream on the transportation path from the transportation roller. The movable knife moves to the fixed knife side in conjunction with an operation closing the access cover, and positions the cleaning member by means of the intervening fixed knife to the retracted position against the urging force of the urging member. In conjunction with the operation starting to open the access cover, the movable knife moves away from the fixed knife and moves the fixed knife to a position not interfering with moving the cleaning member to the cleaning position.

If configured so that the cutter is used to move the cleaning member, a separate mechanism for moving the cleaning member need not be provided. The configuration of the cleaning mechanism can therefore be simplified, the parts count reduced, and the required installation space reduced.

Further preferably, in a transportation roller cleaning mechanism according to another aspect of the invention, the cleaning member is a cleaning lever that is supported pivotably on a pivot path intersecting the transportation roller; an operating member that extends to a position intersecting the path of fixed knife movement when the access cover opens and closes is disposed to the cleaning lever; and the cleaning lever pivots to the retracted position side when the operating member is moved by the intervening fixed knife in conjunction with the operation closing the access cover.

Using this pivot lever simplifies the configuration of the cleaning mechanism.

Another aspect of the invention is a printer including: a storage unit that stores a recording medium; an access cover that opens and closes the storage unit; a printhead that discharges ink onto the recording medium supplied from the storage unit; a transportation mechanism that conveys the recording medium supplied from the storage unit through a transportation path passed a printing position of the printhead, and has a transportation roller that rotates in contact with the printing surface of the recording medium downstream from the printing position; and a transportation roller cleaning mechanism described above.

A printer according to another aspect of the invention includes a storage unit that stores recording medium; an access cover that opens and closes the storage unit; a platen unit disposed above the storage unit; a printhead that is disposed opposite the platen surface of the platen unit and discharges ink onto the recording medium supplied from the storage unit; a transportation mechanism that conveys the recording medium supplied from the storage unit through a transportation path passed a printing position of the printhead, and has a transportation roller that rotates in contact with the printing surface of the recording medium downstream from the printing position; and a transportation roller cleaning mechanism described in the third aspect of the invention described above. The access cover is pivotably supported at the bottom end thereof, the top end of the access cover is connected to a front end part of the platen unit, the platen unit is pulled out in the opening direction of the access cover from above the storage unit in conjunction with the operation of the access cover starting to open, and the movable knife is disposed to the platen unit.

When the access cover of a printer thus comprised starts to open, the movable knife of the cutter also moves and moves the cleaning member to the cleaning position. When the access cover closes, the movable knife moves in the opposite direction and returns and holds the cleaning member in the retracted position.

In a printer according to another aspect of the invention, a recording medium exit is rendered in the closed position of the access cover by the front end part of the platen unit and an edge of a recording medium loading opening that is opened and closed by the access cover; the transportation roller is the follower roller of a pair of rollers that are disposed on opposite sides of and convey the recording medium to the exit; and the drive roller of the pair of rollers is disposed on the platen unit.

In this aspect of the invention the drive roller separates from the follower roller so that the follower roller can rotate freely simultaneously to the cleaning member contacting the follower roller when the access cover starts opening. Cleaning can therefore be done when the access cover is opened.

In a printer according to another aspect of the invention, the follower roller rotates due to contact with the recording medium set on the platen surface of the platen unit when the cleaning member is in contact with the follower roller and the access cover then opens further.

Cleaning occurs automatically when the access cover opens in this aspect of the invention, and the user therefore does not need to pay attention to cleaning. Cleaning can therefore be performed reliably without the user paying attention.

In a printer according to another aspect of the invention, a Teflon® coating is applied to the surface of the transportation roller that contacts the recording medium. This suppresses transfer of adhesion of ink to the transportation roller, and makes removing ink from the transportation roller easier.

Another aspect of the invention is a printer including: a printhead that discharges ink onto a first surface of roll paper; a transportation roller pair that conveys the roll paper, includes a follower roller that contacts the first surface of the roll paper and a drive roller that contacts the second surface of the roll paper, and is located downstream in the transportation direction from the printhead; a cleaning member that can pivot between a first position in contact with the outside surface of the follower roller, and a second position separated from the outside surface of the follower roller; a case that houses the printhead, the follower roller, and the cleaning member, and has an opening for loading the roll paper; a cover that can pivot to a closed position that closes the case opening, and an open position that opens the case opening; an elastic member that positions the cleaning member to the first position when the cover is in the open position; a displacement mechanism that displaces the cleaning member to the second position against the elastic force of the elastic member when the cover is in the closed position; and a support mechanism that supports the drive roller so that the drive roller is positioned to the first position opposite the follower roller when the cover is in the closed position, and is positioned to the second position separated from the follower roller when the cover is in the open position. When the cover moves from the closed position to the open position, the cleaning member moves from the second position to the first position and contacts the outside surface of the follower roller, and the follower roller rotates due to contact with the roll paper, which moves in conjunction with movement of the cover.

In a printer another aspect of the invention, the support mechanism includes a frame to which the drive roller is disposed, and a link mechanism that supports the frame movably in conjunction with opening and closing the cover; the displacement mechanism includes a first stop disposed to the frame, and a second stop disposed to the cleaning member; and when the cover moves from the open position to the closed position, the first stop directly or indirectly contacts the second stop, pushes the cleaning member, and displaces the cleaning member to the second position.

EFFECT OF THE INVENTION

As described above, cleaning occurs in the invention when the access cover opens and closes. Cleaning is therefore performed at least whenever the recording medium, which is a consumable material, runs out, even if the user does not keep track of when cleaning occurs. Cleaning can therefore be performed at the necessary intervals without the user needing to think about it. Cleaning is also not performed during normal media conveyance operations because the cleaning member does not touch the transportation roller when the access cover is closed. Cleaning can therefore be done without affecting transportation performance. In addition, because the access cover opens when cleaning, the ink waste removed from the transportation roller can be smoothly discharged to the outside.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a printer having a cleaning mechanism according to the present invention is described below with reference to the accompanying figures.

Figure 1:
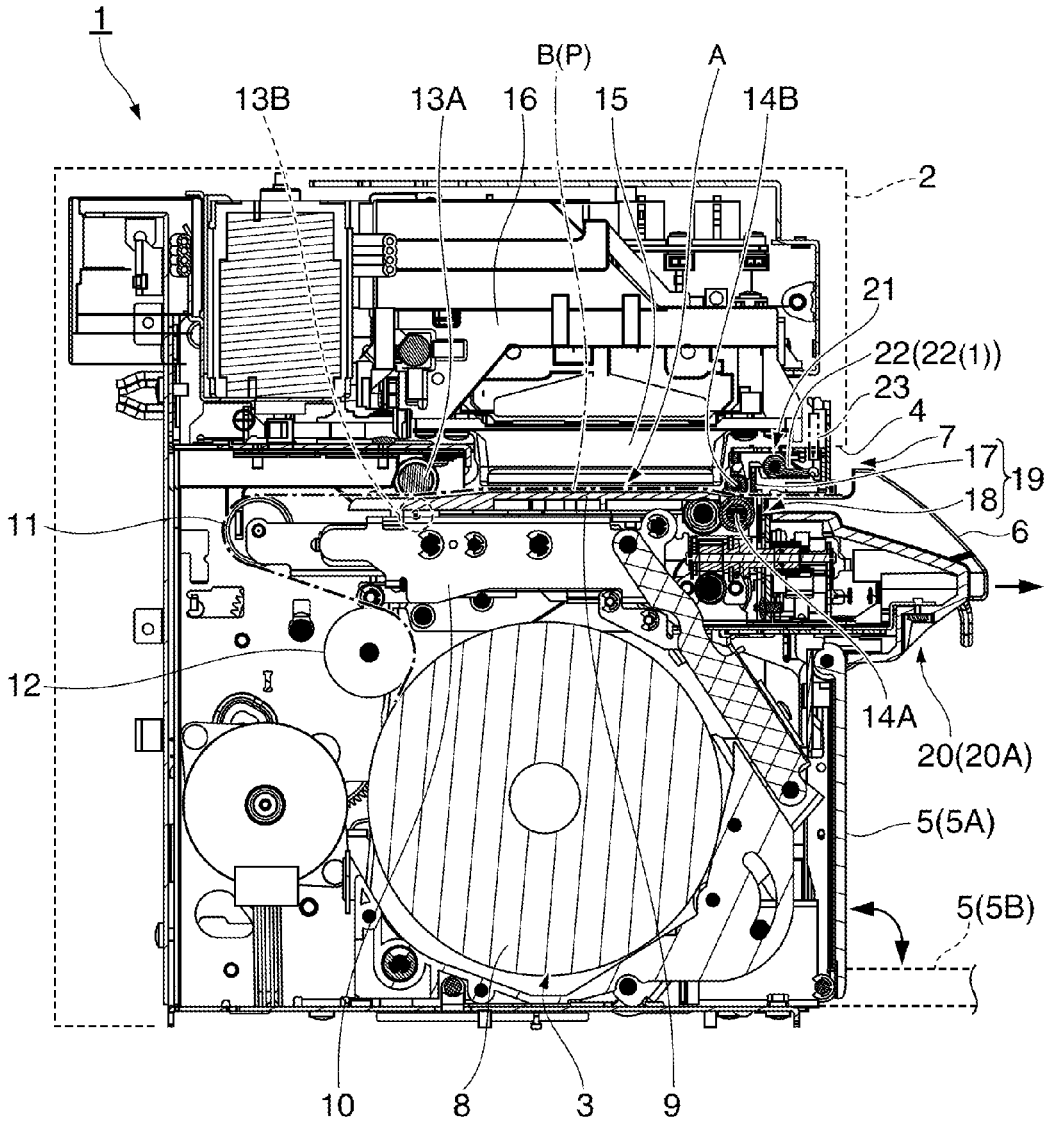
FIG. 1 is a section view showing main parts of a printer according to the invention when the access cover is closed.
Figure 2:
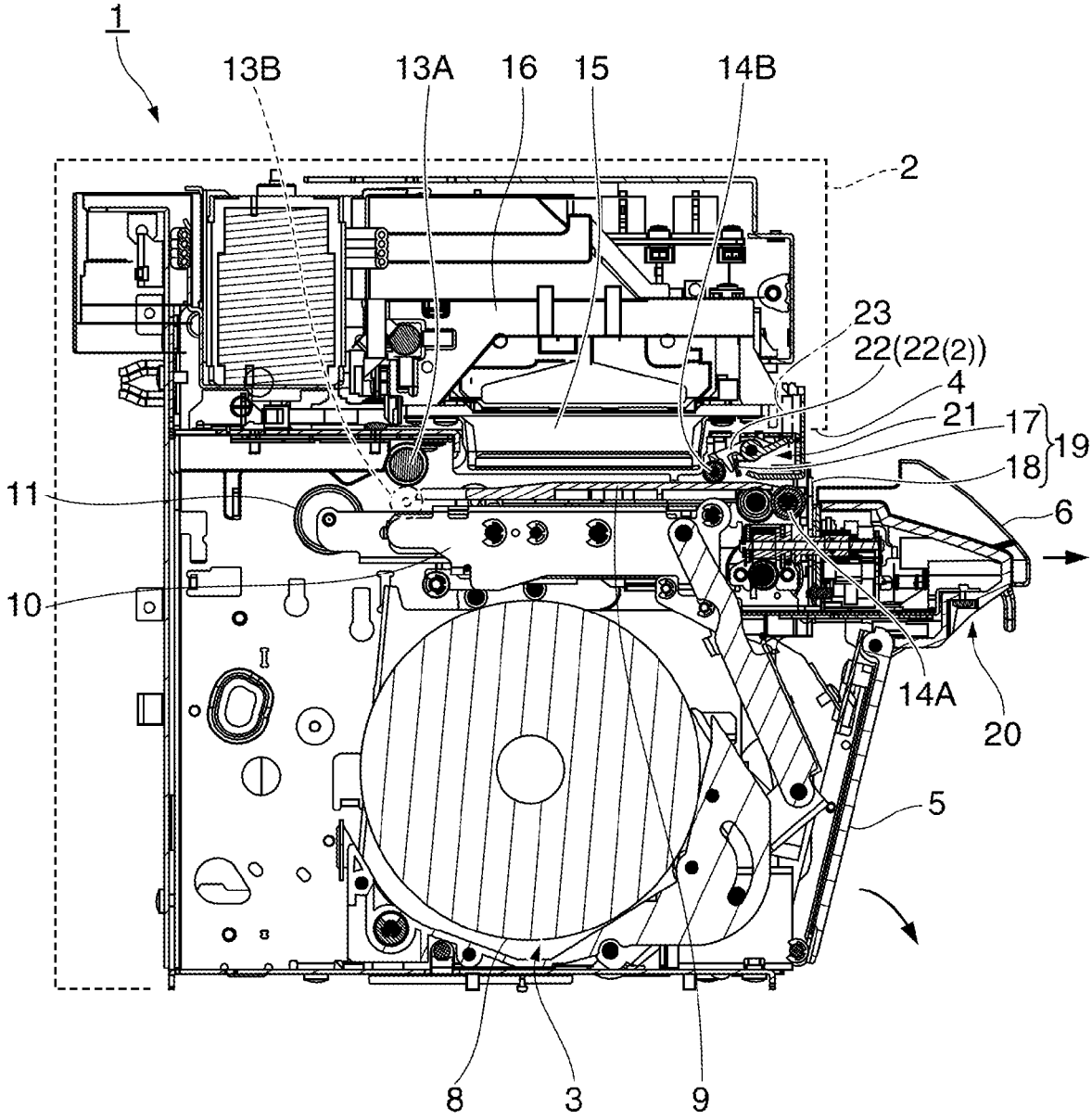
FIG. 2 is a section view showing main parts of a printer according to the invention when the access cover is partially open.

FIG. 1 and FIG. 2 are section views showing the main parts of a printer according to this embodiment of the invention, FIG. 1 showing when the access cover is closed, and FIG. 2 showing when the cover is partially open.

The recording system 1 is for printing on a web of recording media (paper) that is pulled from a paper roll, and has a roll paper compartment 3 (storage unit) formed inside a generally box-like printer case 2. An opening 4 for loading roll paper is formed in the front middle part of the printer case 2. An access cover 5 (opening/closing cover) is disposed to this opening 4, and a paper discharge guide 6 is disposed at the top of the access cover 5.

When the access cover 5 is closed as shown in FIG. 1, a recording paper exit 7 is formed between the paper discharge guide 6 and the top of the opening 4. The access cover 5 can open from a closed position 5A where it is upright at the front of the printer case 2, and pivot on the bottom end thereof forward to an open position 5B. When the access cover 5 is open, roll paper 8 can be dropped with the axis of rotation transverse into the roll paper compartment 3.

A platen frame 10 that carries a platen 9 is disposed directly above the roll paper compartment 3. A tension roller 11 is attached to the back end of the platen frame 10. The recording paper P pulled from the roll paper 8 is fed toward the paper exit 7 through a transportation path B (the path denoted by the dot-dash line in FIG. 1) passed the printing position A defined by the platen 9 surface. More specifically, the recording paper P is supplied from the roll paper 8 at a position towards the back of the printer by the supply roller 12, travels around the tension roller 11 positioned above and to the back of the printer from the supply roller 12, and is conveyed from a position above and behind the roll paper compartment 3 toward the front of the printer. The recording paper P is then conveyed over the surface of the platen 9, and is discharged from the paper exit 7.

A paper feed drive roller 13A is disposed at the back end of the platen 9, and a paper feed follower roller 13B is pressed from below to the paper feed drive roller 13A.

A discharge drive roller 14A is disposed at the front of the platen 9, and a discharge follower roller 14B (paper feed roller or follower roller) is pressed from above to the discharge drive roller 14A.

The recording paper transportation mechanism (transportation means) of the printer 1 is configured to convey the recording paper P through the transportation path B while applying specific tension to the recording paper P by means of the supply roller 12 and tension roller 11, and to convey the recording paper P at two locations, the front and back ends of the platen, by synchronously driving two paper feed roller pairs, the paper feed rollers 13A and 13B, and the discharge rollers 14A and 14B.

A head carriage 16 on which the printhead 15 is carried is disposed movably bidirectionally widthwise to the printer on a carriage guide shaft directly above the platen 9. The printhead 15 is an inkjet head, and is disposed with the nozzle surface facing the top of the platen 9 with a specific gap therebetween. Ink is discharged from the printhead 15 onto the surface of the recording paper P passing the printing position A to print. After passing the printing position A, the recording paper P passes between the discharge drive roller 14A and discharge follower roller 14B, is then cut widthwise by a cutter 19 including a fixed knife 17 and a movable knife 18, and is discharged from the paper exit 7.

The platen 9, paper feed follower roller 13B, discharge drive roller 14A, and the movable knife 18 and drive mechanism of the cutter 19 are mounted on the platen frame 10, and move in unison as a platen unit 20. The tension roller 11 described above is disposed at the back end, and the paper discharge guide 6 is disposed to the front end, of this platen unit 20. The platen unit 20 is supported so that it can move while being held in a horizontal position by a platen support mechanism (not shown in the figure) constructed around a six-joint linkage mechanism.

The top end of the access cover 5 is connected to the bottom of the paper discharge guide 6. When the access cover 5 is closed, the platen unit 20 is in the closed position 20A (shown in FIG. 1) where the platen 9 determines the printing position A of the printhead 15. When a lock not shown is released and the paper discharge guide 6 is pulled forward, the platen unit 20 comes out to the front of the printer as shown in FIG. 2, and the access cover 5 begins to pivot on the bottom end thereof and open to the printer front.

When the access cover 5 then drops from the closed position 5A to the open position 5B, the platen unit 20 is pulled to the front of the printer while moving substantially horizontally, and then descends along a curved path of travel while moving further in front of the printer. The access cover 5 moves in the opposite direction along the same path when closing to the closed position 5A. The platen support mechanism supports the platen unit 20 movably along this path.

When the platen unit 20 moves along this path, the distance from the bottom end part of the paper discharge guide 6 to which the top end of the access cover 5 is connected, to the front end of the bottom panel of the printer frame to which the bottom end of the access cover 5 is connected, changes while the platen unit 20 moves. The access cover 5 in this aspect of the invention therefore has two cover members than are slidably connected to each other. When moving between the closed position 5A and the open position 5B, the access cover 5 therefore expands and contracts in a straight line in conjunction with the change in the distance between the top and bottom ends of the access cover 5 while pivoting on the bottom end thereof. The pivot axis of the access cover 5 is parallel to the rotational axis of the discharge follower roller 14B.

Cleaning Mechanism

The discharge follower roller 14B disposed downstream from the printhead 15 rotates in contact with the printing surface of the recording paper P, and discharged ink that has not finished drying on the printing surface may be picked up and accumulate on the roller surface of the discharge follower roller 14B. A cleaning mechanism 21 for removing ink from the discharge follower roller 14B is therefore disposed downstream from the printhead 15.

As shown in FIG. 1 and FIG. 2, the cleaning mechanism 21 includes a cleaning lever 22 (cleaning member) and a tension spring 23 (urging member). The cleaning lever 22 is pivotably supported with one end extending to above the discharge follower roller 14B. The tension spring 23 pushes up on the other end of the cleaning lever 22.

Figure 3A:
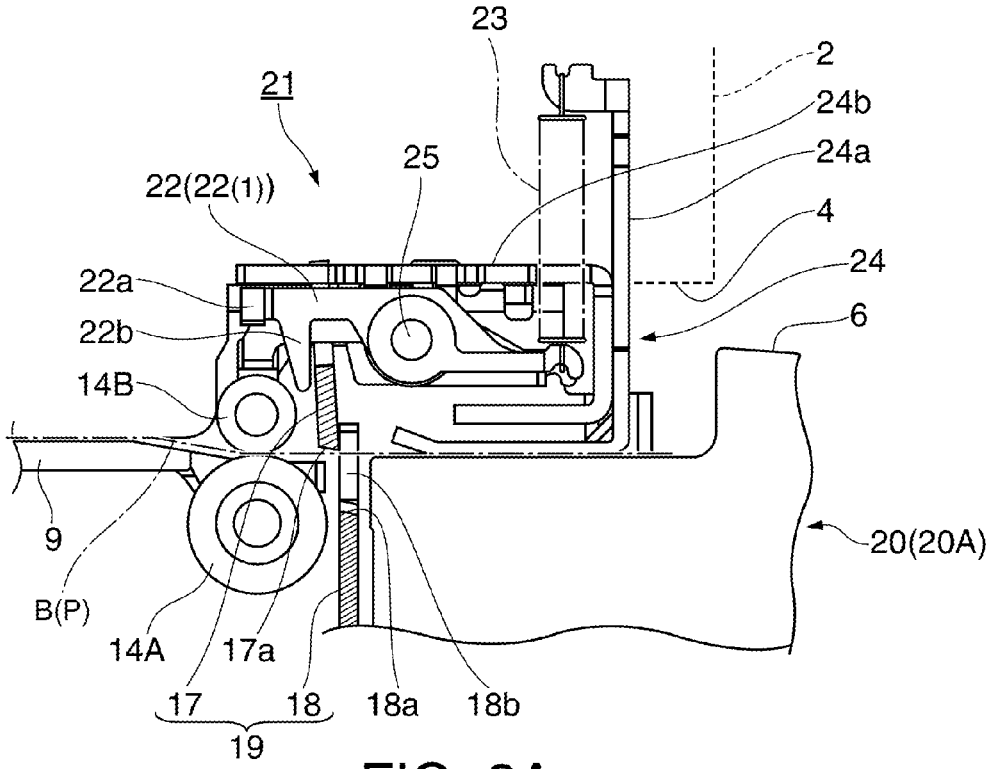
FIG. 3A is a section view showing the cleaning mechanism of to the invention when the cleaning lever is in the retracted position.
Figure 3B:
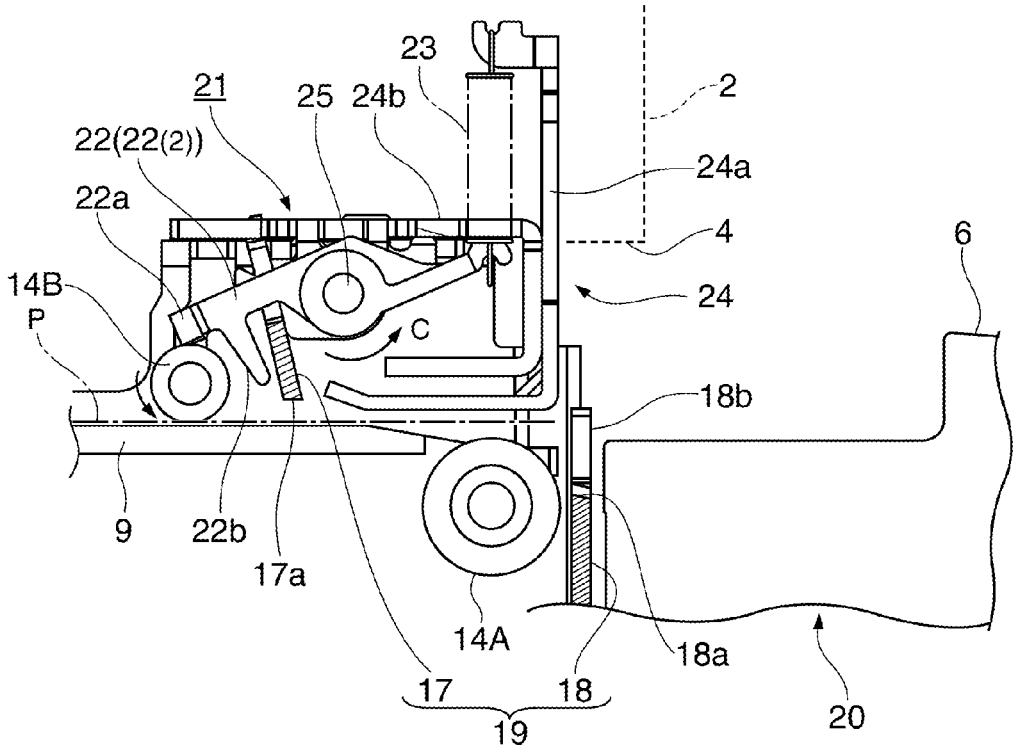
FIG. 3B is a section view showing the cleaning mechanism of the invention when the cleaning lever is in the cleaning position.

FIG. 3A and FIG. 3B are section views showing the configuration of the cleaning mechanism, FIG. 3A showing the access cover 5 closed and the cleaning lever in the retracted position, and FIG. 3B showing the access cover 5 partially open and the cleaning lever in the cleaning position.

The cleaning mechanism 21 support frame 24 is disposed supported by the printer frame (not shown in the figure) on the inside of the top end of the roll paper loading opening 4 formed in the printer case 2. The support frame 24 includes a front frame member 24*a* that extends vertically along the front of the printer case 2, and a top frame member 24*b* that extends that extends horizontally from the inside of the front frame member 24*a* toward the top of the discharge follower roller 14B. The cleaning lever 22 is pivotably supported on a support shaft 25 disposed below the top frame member 24*b*. The support shaft 25 is parallel to the rotational axis of the discharge follower roller 14B. A hook is disposed to the cleaning lever 22 at the front end part extended to the front frame member 24*a* side, and a tension spring 23 is mounted on this hook and a hook formed at the top end of the front frame member 24*a*.

Figure 4:
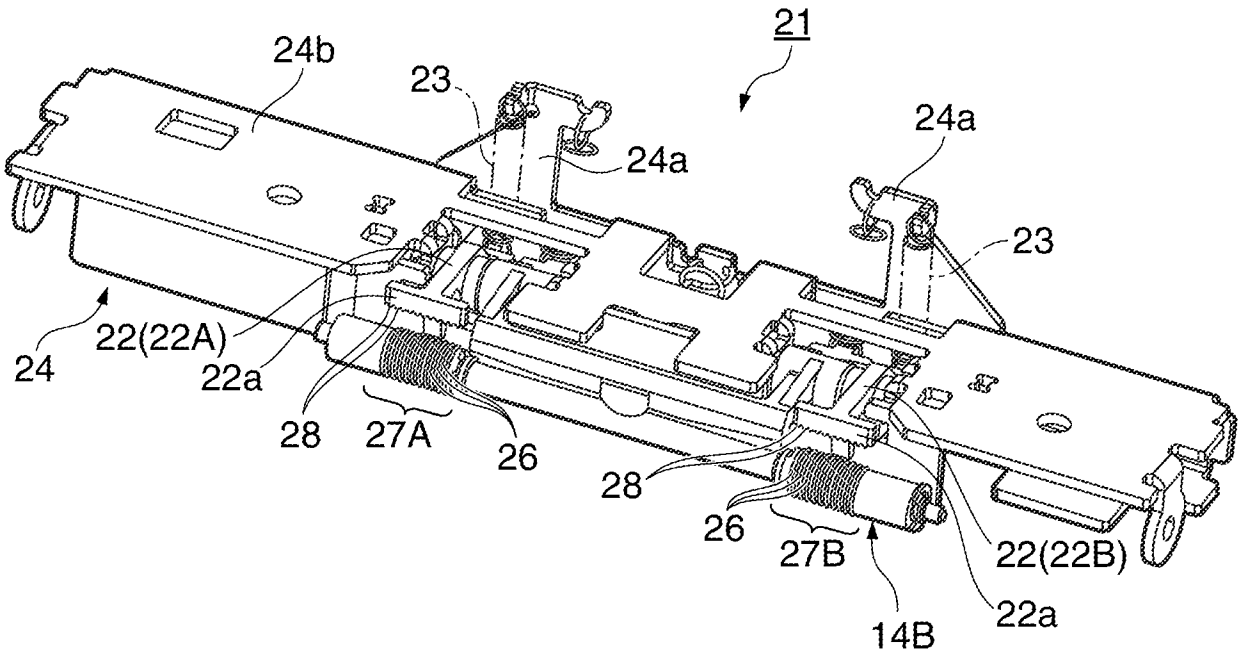
FIG. 4 is an oblique view from diagonally above the cleaning mechanism.
Figure 5:
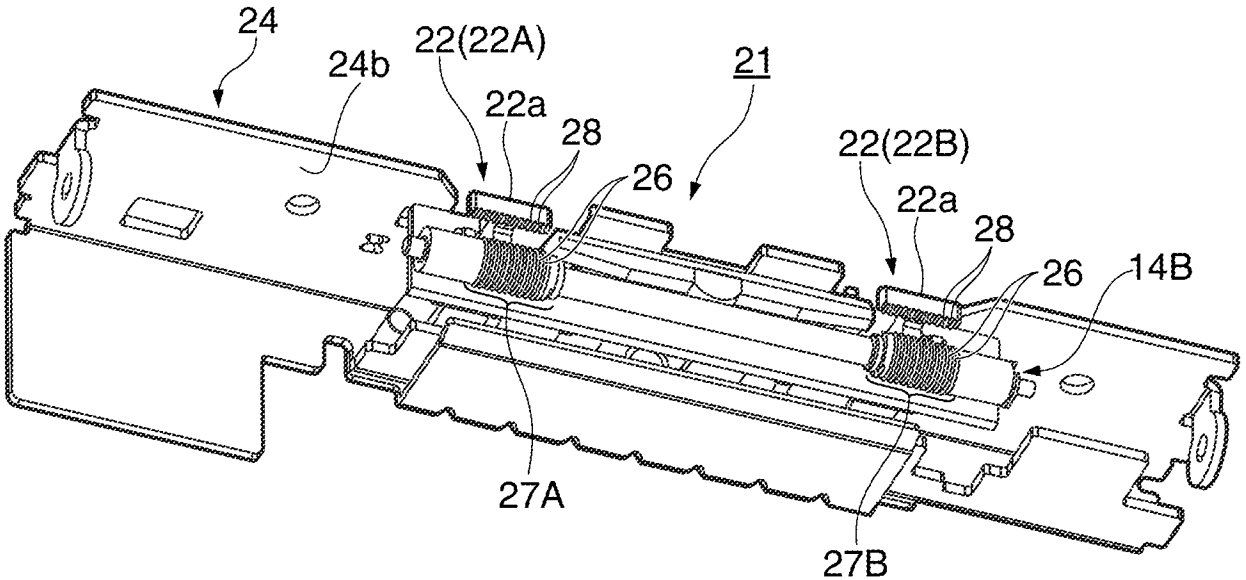
FIG. 5 is an oblique view from diagonally below the cleaning mechanism.

FIG. 4 and FIG. 5 are oblique views of the cleaning mechanism, FIG. 4 being an oblique view from diagonally above and FIG. 5 being an oblique view from diagonally below the cleaning mechanism. As shown in these figures, roller surfaces 27A and 27B are formed with a specific length in the axial direction at opposite ends of of the discharge follower roller 14B, and grooves 26 are formed at a specific pitch around the circumference of the roller surfaces 27A and 27B. The roller surfaces 27A and 27B rotate in contact with areas along the left edge and the right edge of the recording paper P, and together with the discharge drive roller 14A hold and convey the recording paper P. The roller surfaces 27A and 27B are coated with Teflon®, for example, to create a surface finish that resists the adhesion of ink thereto and makes removing any ink therefrom easy. In this embodiment of the invention there are two cleaning levers 22, a cleaning lever 22A that extends to above roller surface 27A, and a cleaning lever 22B that extends to above roller surface 27B.

The width of the back end part 22*a* of the cleaning lever 22A that extends to above the roller surface 27A corresponds to the width of the roller surface 27A. The surface of the side of the back end part 22*a* that faces the roller surface 27A is a serrated surface having numerous serrations 28 that protrude in the same direction as the direction of the grooves 26 and are formed at a pitch corresponding to the grooves 26. Except for their locations, the other cleaning lever 22B and roller surface 27B are configured identically to the cleaning lever 22A and roller surface 27A, respectively.

As shown in FIG. 2 and FIG. 3B, when the front end parts of the cleaning levers 22 (22A, 22B) are pushed up by the urging force of the tension spring 23 (the urging force of the elastic member), and the cleaning levers 22 (22A, 22B) pivot in the direction of arrow C in FIG. 3B, the back end part 22*a* of each cleaning lever 22 (22A, 22B) is set in contact with the roller surfaces 27A and 27B. The serrations 28 on the cleaning levers 22 (22A, 22B) mesh with the grooves 26 in the roller surfaces 27A and 27B at this time. As a result, when the discharge follower roller 14B rotates, ink accumulated on the roller surfaces 27A and 27B is wiped off by the back end parts 22*a* of the cleaning levers 22A, 22B. The serrations 28 scrape ink from the grooves 26 at this time.

When the access cover 5 is in the closed position 5A, the cleaning levers 22 (22A, 22B) are held in the retracted position 22(1) where the back end parts 22*a* are not in contact with the roller surfaces 27A and 27B in resistance to the urging force of the tension spring 23 as shown in FIG. 1 and FIG. 3A.

When the access cover 5 starts to open and is released from being held in this retracted position 22(1), the cleaning levers 22 (22A, 22B) pivot in the direction urged by the tension spring 23 as shown in FIG. 2 and FIG. 3B, and the back end parts 22*a* move to the cleaning position 22(2) in contact with the roller surfaces 27A and 27B.

This function of moving and holding the cleaning levers 22A, 22B in the retracted position 22(1) when the access cover 5 closes, and releasing the cleaning levers 22A, 22B from this position when the access cover 5 starts opening, is rendered as described below by the cutter 19 that is disposed below the cleaning mechanism 21 for cutting the recording paper.

As shown in FIG. 3A, the bottom end part of the front frame member 24*a* part of the cleaning mechanism 21 bends and extends toward the back of the printer, and the fixed knife 17 and movable knife 18 of the cutter 19 described above are disposed between this end of the front frame member 24*a* and the discharge follower roller 14B.

The movable knife 18 is disposed with the cutting edge 18*a* thereof facing up below the transportation path B through which the recording paper P passes. The fixed knife 17 is disposed above the transportation path B with the cutting edge 17*a* thereof facing down. The cutter 19 is configured to cut the recording paper P when a drive mechanism disposed on the platen unit 20 side moves the movable knife 18 to and from the fixed knife 17. An operating tab 22*b* (second stop) formed on the cleaning levers 22 (22A, 22B) is disposed between the fixed knife 17 and discharge follower roller 14B in this embodiment of the invention.

In FIG. 1 and FIG. 3A the access cover 5 is in the closed position 5A, and the cutting edge 18*a* of the movable knife 18 is lower than the cutting edge 17*a* of the fixed knife 17. A fixed knife pressure plate 18*b* (first stop) that extends above the cutting edge 18*a* of the movable knife 18 is formed at a position outside of the area of the movable knife 18 where the recording paper P passes. The fixed knife 17 and movable knife 18 are thus disposed with the fixed knife 17 on the upstream side in the transportation direction (the same side as the discharge follower roller 14B), the movable knife 18 on the downstream side in the transportation direction (the same side as the paper exit 7), and the fixed knife 17 disposed with the cutting edge 17*a* urged toward the movable knife 18 side (downstream in the transportation direction). When the access cover 5 is in the closed position 5A, the platen unit 20 is in the closed position 20A, and at least the fixed knife pressure plate 18*b* part of the movable knife 18 mounted on the platen unit 20 is touching the fixed knife 17 and pushes the fixed knife 17 in resistance to the urging force toward the discharge follower roller 14B side.

More specifically, when the access cover 5 closes, the fixed knife 17 is moved to and positioned at the operating tab 22*b* side in resistance to the urging force, and the operating tab 22*b* of the cleaning lever 22 is moved and positioned by the pressure applied by contact with the fixed knife 17 to the discharge follower roller 14B side.

As a result, the cleaning levers 22A, 22B pivot to the retracted position 22(1) against the urging force of the tension springs 23. Because the movable knife 18 is pressed against the fixed knife 17 in this state, the movable knife 18 can be moved vertically to cut the recording paper P.

When the access cover 5 starts to open, the platen unit 20 is pulled to the front of the printer, and the movable knife 18 separates from the fixed knife 17 as shown in FIG. 2 and FIG. 3B. As a result, the fixed knife 17 returns to the position with the cutting edge 17*a* inclined toward the front of the printer, and the fixed knife 17 separates from the operating tab 22*b*. As a result, the cleaning levers 22A, 22B return from the pivoted position controlled by the fixed knife 17 to the cleaning position 22(2) in the direction urged by the tension spring 23. The back end parts 22*a* of the cleaning levers 22A, 22B are thus set in contact with the roller surfaces 27A and 27B of the discharge follower roller 14B.

When the access cover 5 starts opening, that is, when the platen unit 20 starts moving toward the front of the printer, the discharge drive roller 14A mounted on the platen unit 20 separates from the discharge follower roller 14B. As a result, the discharge follower roller 14B can turn.

If the access cover 5 opens further after the cleaning levers 22A, 22B contact the roller surfaces 27A and 27B, the recording paper P set below the discharge follower roller 14B will be pulled substantially parallel to the platen unit 20. Contact between the recording paper P being conveyed and the discharge follower roller 14B at this time causes the discharge follower roller 14B to also turn. As a result, accumulated ink is wiped from the roller surfaces 27A and 27B of the discharge follower roller 14B by the cleaning levers 22A, 22B at this time. The removed ink waste is automatically removed from the printer because it falls onto the recording paper P therebelow and is pulled out to the front of the printer with the recording paper P. The discharge follower roller 14B is thus cleaned in conjunction with movement of the access cover 5.

The discharge follower roller 14B is also similarly cleaned when the access cover 5 closes. More specifically, when the access cover 5 closes, the platen unit 20 returns to the back of the printer, and the platen 9 passes below the discharge follower roller 14B with the recording paper P set on the platen surface. As a result, contact with the recording paper P causes the discharge follower roller 14B to rotate therewith in the opposite direction as when the access cover 5 opens, and the discharge follower roller 14B is thus cleaned. In addition, because a length of recording paper P is fed to prepare for the next print job after the access cover 5 is closed, the ink waste that falls onto the recording paper P as a result of cleaning when the access cover 5 is closed is automatically discharged from the printer 1 with the recording paper P that is discharged from the paper exit 7 during this setup process.

As described above, the cleaning mechanism 21 of a printer 1 according to this embodiment of the invention can clean in conjunction with operations opening and closing the access cover 5, and the discharge follower roller 14B can therefore be cleaned automatically when the roll paper 8 is replaced, for example. Cleaning is therefore performed at least every time the roll paper 8 is replaced even without the user managing the frequency of cleaning. In addition, because the access cover 5 is not opened and closed during normal paper feed operations, cleaning is not performed during normal paper feed operations in this printer 1. As a result, recording medium transportation performance (paper feed performance) is not lowered by the cleaning operation. Ink waste can also be smoothly discharged to the outside because the recording paper P onto which the waste ink that was wiped off falls is discharged to the outside in conjunction with opening and closing the access cover 5.

Variations (1) The cutter 19 moves and holds the cleaning lever 22 in the retracted position 22(1) in the foregoing embodiment. In a printer that does not require a cutter, however, an operating member extending to a position where it can contact the operating tab 22*b* can be rendered on the platen unit 20, and this operating member can push the operating tab 22*b* directly to pivot the cleaning lever 22. For example, a configuration in which the operating member is connected to the discharge drive roller 14A and the cleaning lever 22 is released when the discharge drive roller 14A separates from the discharge follower roller 14B is also conceivable.

(2) A pivotable cleaning lever 22 is used as the cleaning member in the foregoing embodiment, but a cleaning member with a different configuration could be used instead. For example, a cleaning member that slides up and down could be disposed above the discharge follower roller 14B and urged down, an inclined guide surface could be formed on the bottom of this cleaning member, and an operating member that extends facing up could be disposed to the platen unit 20. When the platen unit 20 in this configuration returns to the closed position 20A, the operating member on the platen unit 20 contacts the inclined surface when returning to the discharge follower roller 14B side and pushes the cleaning member up, thereby separating the cleaning member from the discharge follower roller 14B. In addition, when the access cover 5 starts to open and the platen unit 20 is pulled out from the closed position 20A, the operating member is pulled out to a position where it does not interfere with the descent of the cleaning member. The cleaning member therefore descends and contacts the discharge follower roller 14B. As a result, cleaning is performed when the access cover opens and closes, similarly to the cleaning lever 22 described above.

(3) Grooves 26 are formed on the roller surfaces 27A and 27B of the discharge follower roller 14B to suppress ink accumulation, but the shape of these grooves is not limited to circumferential. For example, grooves could be formed in the roller surfaces 27A and 27B along the axial direction of the discharge follower roller 14B, and straight ridges extending parallel to these grooves could be formed in the back end parts 22*a* of the cleaning levers 22.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A transportation roller cleaning mechanism that is a cleaning mechanism for removing ink from a transportation roller that rotates in contact with the printing surface of a recording medium at a position downstream on the recording medium transportation path from a printing position where ink is discharged onto the passing recording medium, comprising:

a cleaning member that can move between a cleaning position in contact with the transportation roller and a retracted position not in contact with the transportation roller, moves to the cleaning position in contact with the transportation roller in conjunction with an operation starting to open an access cover for opening and closing a storage unit that holds the recording medium that is supplied to the printing position, and moves to the retracted position not in contact with the transportation roller in conjunction with an operation closing the access cover;

an urging member that urges the cleaning member to the cleaning position side; and a cutter having a movable knife and a fixed knife that is urged to the movable knife side downstream on the transportation path from the transportation roller, the movable knife moving to the fixed knife side in conjunction with an operation closing the access cover, and positioning the cleaning member by the intervening fixed knife to the refracted position against the urging force of the urging member, and moving away from the fixed knife in conjunction with the operation starting to open the access cover, and moving the fixed knife to a position not interfering with moving the cleaning member to the cleaning position.

2. The transportation roller cleaning mechanism described in claim 1, wherein:

a groove is formed in the roller surface of the transportation roller; and a protrusion corresponding to the groove is formed in the surface of the cleaning member that contacts the transportation roller.

3. The transportation roller cleaning mechanism described in claim 1, wherein:

the cleaning member is a cleaning lever that is supported pivotably on a pivot path intersecting the transportation roller;

an operating member that extends to a position intersecting the path of fixed knife movement when the access cover opens and closes is disposed to the cleaning lever; and the cleaning lever pivots to the refracted position side when the operating member is moved by the intervening fixed knife in conjunction with the operation closing the access cover.

4. A printer comprising:

a storage unit that stores a recording medium;

an access cover that opens and closes the storage unit;

a printhead that discharges ink onto the recording medium supplied from the storage unit;

a transportation mechanism that conveys the recording medium supplied from the storage unit through a transportation path passed a printing position of the printhead, and has a transportation roller that rotates in contact with the printing surface of the recording medium downstream from the printing position; and a transportation roller cleaning mechanism described in claim 1.

5. The printer described in claim 4, wherein:

a Teflon® coating is applied to the surface of the transportation roller that contacts the recording medium.

6. A printer comprising:

a storage unit that stores recording medium;

an access cover that opens and closes the storage unit;

a platen unit disposed above the storage unit;

a printhead that is disposed opposite the platen surface of the platen unit and discharges ink onto the recording medium supplied from the storage unit;

a transportation mechanism that conveys the recording medium supplied from the storage unit through a transportation path passed a printing position of the printhead, and has a transportation roller that rotates in contact with the printing surface of the recording medium downstream from the printing position; and a transportation roller cleaning mechanism described in claim 1;

wherein the access cover is pivotably supported at the bottom end thereof, the top end of the access cover is connected to a front end part of the platen unit, the platen unit is pulled out in the opening direction of the access cover from above the storage unit in conjunction with the operation of the access cover starting to open, and the movable knife is disposed to the platen unit.

7. The printer described in claim 6, wherein:

a recording medium exit is rendered in the closed position of the access cover by the front end part of the platen unit and an edge of a recording medium loading opening that is opened and closed by the access cover;

the transportation roller is the follower roller of a pair of rollers that are disposed on opposite sides of and convey the recording medium to the exit; and the drive roller of the pair of rollers is disposed on the platen unit.

8. The printer described in claim 7, wherein:

the follower roller rotates due to contact with the recording medium set on the platen surface of the platen unit when the cleaning member is in contact with the follower roller and the access cover then opens further.

9. The printer described in claim 6, wherein:

a Teflon® coating is applied to the surface of the transportation roller that contacts the recording medium.

* * * * *